US005755016A

United States Patent [19]

Provost

[11] Patent Number: 5,755,016

[45] Date of Patent: May 26, 1998

[54] HOOK AND LOOP FASTENING AND THE LIKE

[75] Inventor: George A. Provost, Litchfield, N.H.

[73] Assignee: Velcro Industries, B.V., Curacao, Netherlands Antilles

[21] Appl. No.: 771,980

[22] Filed: Dec. 23, 1996

[51] Int. Cl.[6] ..... A44B 18/00

[52] U.S. Cl. ..... 24/452; 24/450; 24/442

[58] Field of Search ..... 24/306, 442–452, 24/575–577

[56] References Cited

U.S. PATENT DOCUMENTS

| | | | |
|---|---|---|---|
| 3,261,069 | 7/1966 | Mathison . | |
| 3,546,754 | 12/1970 | Erb . | |
| 3,708,833 | 1/1973 | Ribich et al. | 24/450 |
| 3,808,646 | 5/1974 | Brumlik | 24/452 X |
| 3,879,835 | 4/1975 | Brumlik . | |
| 3,913,183 | 10/1975 | Brumlik . | |
| 4,775,310 | 10/1988 | Fischer . | |
| 4,887,339 | 12/1989 | Bellanger | 24/577 X |
| 5,131,119 | 7/1992 | Murasaaki et al. . | |
| 5,208,952 | 5/1993 | Mintel et al. | 24/575 X |
| 5,235,731 | 8/1993 | Anzai et al. | 24/576 |
| 5,315,740 | 5/1994 | Provost | 24/452 |
| 5,339,499 | 8/1994 | Kennedy et al. | 24/452 |
| 5,625,930 | 5/1997 | Takizawa et al. | 24/452 |

FOREIGN PATENT DOCUMENTS

| | | |
|---|---|---|
| WO 94/29070 | 12/1994 | WIPO . |
| WO 95/01863 | 1/1995 | WIPO . |

*Primary Examiner*—James R. Brittain
*Assistant Examiner*—Robert J. Sandy
*Attorney, Agent, or Firm*—Fish & Richardson P.C.

[57] ABSTRACT

A fastener member useful for separable engagement with surface fibers of a low-loft, non-woven fabric, or the like, has a base web and a multitude of fastener elements formed with and extending from the base web. The fastener elements have a profile that comprises an elongated stem portion adjacent the base web and inclining at an acute angle to the base. A crook portion is formed on the end of the stem and is directed oppositely to the direction of inclination of the stem, being exposed for engaging a mating fastening member. The acute angle of the stem of the elements enables them to flex toward the base. Offset pairs of such elements can cooperatively move in a pincer-type motion to engage fibers and to retain engaged fibers. Other element configurations are disclosed. The fastener member has particular application for fastening of disposable products such as garments and diapers.

18 Claims, 6 Drawing Sheets

HOOK AND LOOP FASTENING AND THE LIKE

BACKGROUND OF THE INVENTION

The invention relates to hook-and-loop fasteners and, in particular, to hook fastener members suited for fastening engagement with non-woven materials and to fastening systems employing such hook and loop fasteners.

In general, hook-and-loop fasteners comprise two mating components: a hook member, having upstanding hook engaging elements, and a loop member having a nappy surface in which the engaging elements of the hook member become ensnarled to effect fastening engagement of the two components. In early times, both the hook member and the loop member were made by textile processes.

Much of the effort in the field has focused on finding improved hook designs capable of being formed by molding techniques and on finding other types of material, besides the traditional textiles, for the loop member.

Many desirable hook materials are formed with molds in a continuous process according to Fischer U.S. Pat. Nos. 4,794,028 and 4,872,243 or by injection molding employing stationary plates that are similar to those used by Fischer. To achieve moldability and desired strength properties in the resultant fastening, the engaging elements have typically arched over the base as shown by Provost et al. in U.S. Pat. No. 4,984,339, such that the tips of the hooks face generally downwardly beyond the corresponding side of their supporting stems, to provide upward recesses between the tips and the stems in which loops can be retained.

For loop members it is desired to use non-woven materials, referred to in the trade as "non-wovens." In the context of the invention, the term "loops" and "loop member" will be used broadly as referring to any element or member that corresponds to the loops or loop-bearing members traditionally used for hook-and-loop-type fasteners.

Be cause they are relatively inexpensive, non-wovens are desired as the loop member part of the closure on low cost items, such as disposable diapers, surgical gowns, and sanitary napkins. Typically, the less expensive the nonwoven materials, the shorter the height of the loops of the material, and the more prone are they to being matted or compacted under conditions of storage and packaging that make the loops difficult to be engaged by the mating hooks.

SUMMARY OF THE INVENTION

It is realized that non-wovens can be advantageously engaged by an acutely-angled, cantilevered hook fastener element with an inverted crook. In certain cases improved resistance to shear lo ads i s obtainable. In certain cases the design of the elements enables them to bend toward the base web of the fastener strip when loaded against a non-woven material or other mating surface to present a penetrating tip with very low displacement volume to engage the material.

It is further realized that offset pairs of such acutely-angled inverted elements can move in a complementary pincer-type motion, further improving the engagement and retainment of low-lying loops or other engageable structure of the mating material.

A fastener member useful for separable engagement with surface fibers of a low-loft, non-woven fabric, or the like, is provided. The fastener member comprises a base web and a multitude of fastener elements formed with and extending from a base at the base web. At least some of the fastener elements have a profile that comprises an elongated stem portion adjacent the base web and inclined at an acute angle therewith, and a crook portion formed on the end of the stem distal to the base web. The crook portion is directed oppositely to the direction of inclination of the stem and exposed for engaging cooperating fastening features.

The fastener member can comprise a molded strip having at least one row of fastener elements extending in the direction of extent of the strip, with the profiles of the fastener elements aligned with the row.

The fastener elements that have such profiles can have a thickness of about 0.006 inch or less, a height of about 0.015 inch or less from the base web, and a displacement volume (defined as the volume of a rectangular parallelepiped having a bottom plane, first and second side planes, first and second end planes and a top plane) of less than about $0.20\times10^{-6}$ cubic inches. The bottom plane is oriented parallel to the base and includes an interior ledge of the crook. The top plane is parallel to the base and tangent to the top of the element at the point most distant from the base. The side planes lie in planes projected along the sides of the element. The first end plane is perpendicular to the bottom plane and includes the side of the intersection of the bottom plane and the stem farthest from the tip. The second end plane is tangent to the portion of the tip farthest from the first end plane.

The acute angle can be between about 20 and 50 degrees, or about 30 degrees, the stem being resiliently deflectable in motion toward the base web when the fastener member is engaged with face-to-face pressure against a mating member tending to open the crook outwardly, release of the pressure tending to close the crook in an engaging motion.

Fastener elements having the specified profiles can be arranged in offset pairs, which pairs comprise adjacent fastener elements that are opposed in pincer-like fashion such that the distal ends of the crooks in a pair are oriented to face generally toward each other, whereby force applied to the ends of the fastener elements toward the base web causes the fastener elements to move generally away from each other as the stems each flex relative to the base web, and the crooks move back toward each other upon removal of the force. The fastener elements of a pair can be disposed in adjacent parallel rows of fastener elements.

The distal ends of the fastener elements of an offset pair, in an unstressed condition, can be separated by a distance of about 0.010 inch or less in the direction of the rows.

At least some of the fastener elements having the specified profiles can be each arranged adjacent a respective opposing structure. The opposing structure cooperates with the crook portion of the fastener element to engage the cooperating fastening features. The opposing structures can be post-shaped and have a height from the base approximating the height of the fastener elements.

A disposable garment is also featured, having a nonwoven fabric and the above-described fastener member disposed to engage the non-woven fabric. The garment can, for instance, be a diaper.

A fastener member, according to the invention, can have a multiplicity of fastener elements, at least many of which each comprises a stem extending as an angled cantilever arm in a first direction along a base web, and a hook carried on the free end of the cantilever arm and directed in a second direction, such that elastic deflection of the cantilever arm in movement toward the base web opens the hook, and elastic return motion of the cantilever arm to its undeflected position returns the hook to its initial disposition.

The fastener member can have a set of two of the fastener elements, with the fastener elements of the set directed generally toward each other such that the movements of their cantilever arms effectively, respectively, enlarges and reduces the distance between their hooks in a pincer-like motion.

A fastening is also provided, comprising the above-described fastener member and a mating non-woven fabric having surface fibers engageable by the hooks.

DESCRIPTION OF THE PREFERRED EMBODIMENTS

Figure 1:
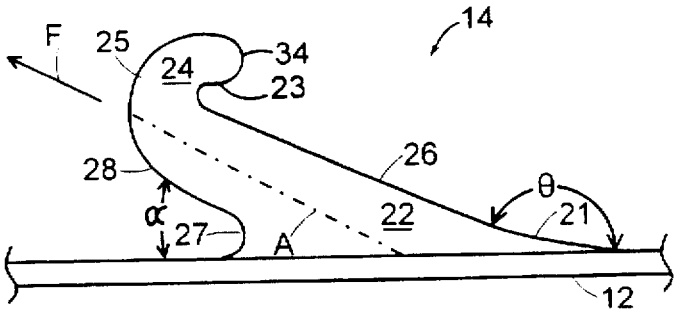
FIG. 1 is an enlarged side view of a hook fastener element according to the invention.
Figure 3:
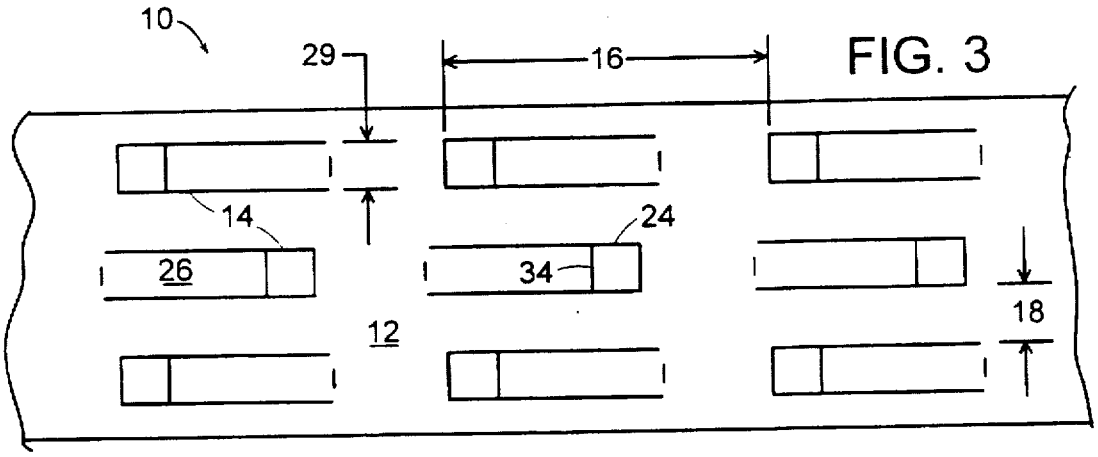
FIG. 3 is a plan view of the strip of FIG. 2.
Figure 2:
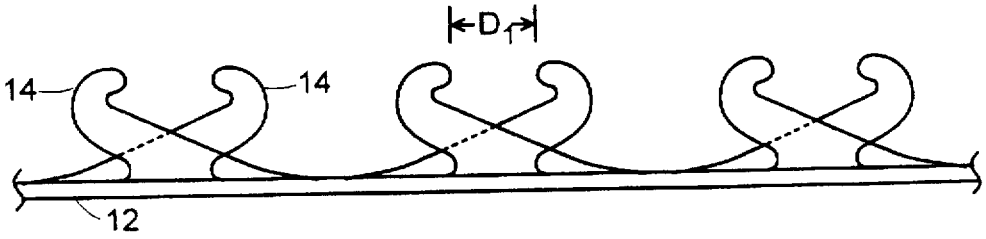
FIG. 2 is a side elevational view of a hook fastener strip with opposed hook fastener elements according to FIG. 1.

As shown in FIGS. 1, 2 and 3, a molded hook fastener strip 10 includes a base member 12 and a plurality of hook fastener elements 14 integrally molded with and extending from the base member.

As shown in detail in FIG. 1, fastener element 14 has a generally inclined stem portion 22 that forms a cantilever in one direction, A, and an arc-shaped crook portion 24 which is directed substantially laterally in the direction opposite to the direction of incline of the stem. The incline of the stem portion relative to the base member 12 is more specifically defined in that, beyond fillet 21, it has an upper surface 26 that forms an obtuse angle θ relative to the base member 12 and, beyond fillet 27, a lower surface 28 that forms an acute angle α relative to the base member. The stem portion that overhangs fillet 27 effectively defines a cantilever arm that is resiliently bendable in its plane.

To enable the hook 34 to open to capture loops when pressed against a mating fabric, angle α is preferably between 20 and 50 degrees, most preferably about 30 degrees.

The crook portion 24 is "inverted" in that, instead of bending downward from its stem as in many hooks, it instead "doubles back" over the upper surface of the stem, similarly to the top of the letter "S" or "Z". The hook is therefore situated above the cantilever portion and able to deflect with it. In this form, the side of the hook tip provides a lower ledge 23 which is generally parallel to the base member 12 and close to the top of the element, while the neck of the crook, 25, extends upwardly. Because of this form, relatively little depth of penetration of the element into the loop fabric is required to enable loops to reach and engage ledge 23.

The shape of the inverted fastener elements shown in FIGS. 1 through 3 makes them particularly suited for resisting forces having a predominant shear component in a direction parallel to the fastener strip. Because angle α is relatively small, a force F, having a predominant shear component and applied to the fastener element by an engaged loop, is substantially resisted by tensile forces within the stem 22 of the fastener element. As the applied load F is generally aligned with the direction of resin flow as the resin enters the mold cavity during formation of the fastener element, in certain instances polymer chains within the stem are advantageously aligned to resist the shear loads.

For engagement with fine-featured non-wovens, the hooks are small and densely packed. In the preferred embodiment of FIG. 3, the linear spacing 16 of fastening elements 14 within a given row is preferably between about 0.010 inch and about 0.020 inch, with about 0.015 inch being most preferable. The distance 18 between rows of fastener elements is preferably less than about 0.008 inch. The thickness 29 of the fastener elements is preferably between about 0.003 inch and about 0.010 inch, with 0.006 inch being most preferable. For other applications, a wide range of dimensions may be employed.

Although the fastener elements 14 may all be oriented in one direction along the fastener strip, or interspersed with other elements or structure that may coact with them, a preferred arrangement has alternating rows of identical fastener elements 14 facing opposite directions, as shown in FIG. 2. In this configuration, the fastener elements are advantageously arranged to resist shear loads in either direction along the strip.

When suitably positioned and spaced, as generally shown, adjacent fastener elements cooperatively move in a self-actuating pincer motion for enhancing the grip on loops of the mating fastener components.

Figure 4A:
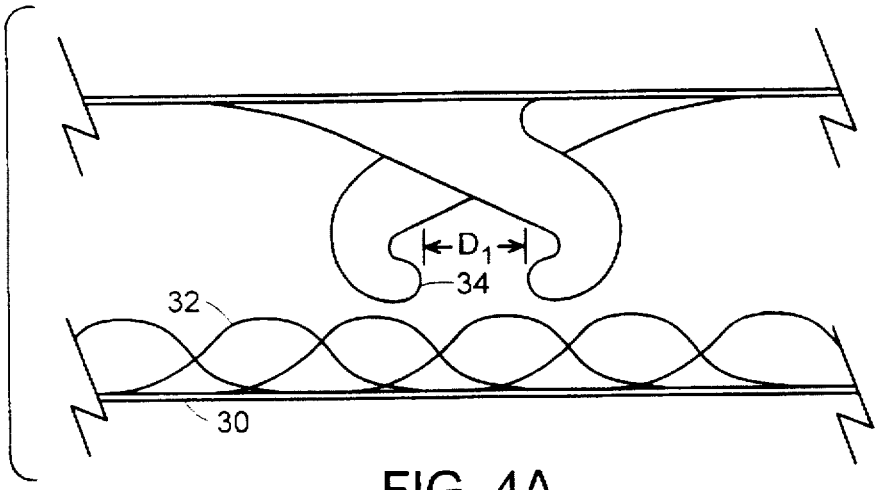
FIGS. 4A through 4C illustrate the engagement of the hook fastener elements with a non-woven as a fastening system.
Figure 4B:
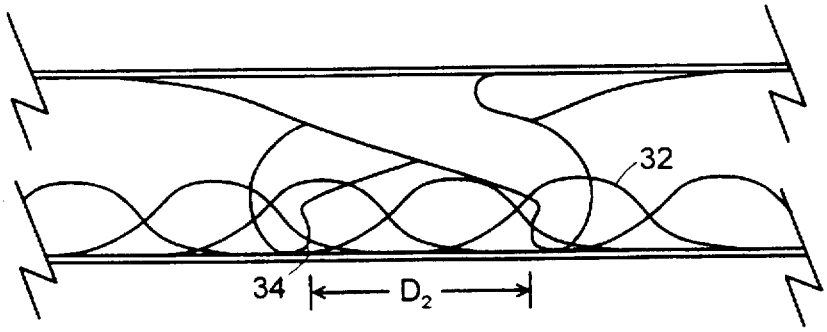
Figure 4C:
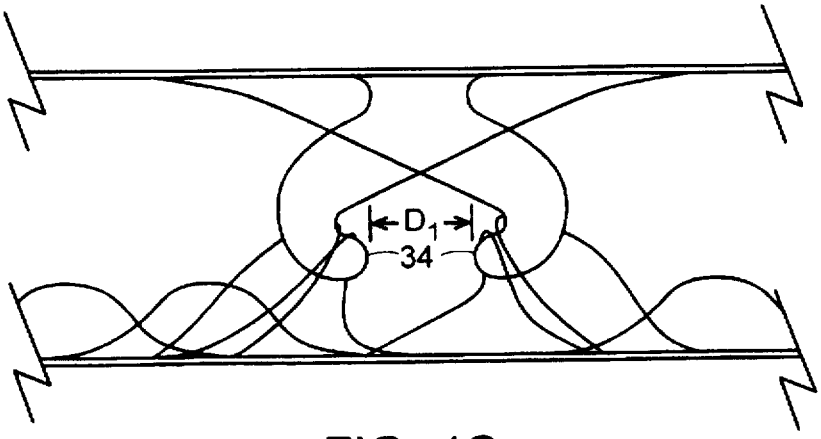

FIGS. 4A–4C illustrate the pincer motion of the fastener elements 14 of the preferred embodiment during engagement with a mating non-woven 30 having loops 32. As the fastener strip 10 is pressed face-to-face against the non-woven 30 (FIG. 4B), the cantilevered stems 22 of fastener elements 14 resiliently deflect toward the base member 12 of the fastener strip under the applied load. In a motion similar to opening a pair of scissors, the fastener elements flex away from each other, increasing the separation between the facing tips 34 to a distance $D_2$, of about 0.015 inches in the embodiment shown. The crook portions 24 of the fastener elements are simultaneously bent backward, opening the underside area of the crook for improved engageability with loops 32. Penetration into the loop fastener is improved in part because the bent crooks present a smaller projected area to the loop fabric than the crooks in their molded shape. When the applied load is removed, the fastener elements 14 spring back substantially to their as-molded disposition, with facing tips 34 separated by a distance $D_1$, where $D_1$, is preferably less than 0.010 inches. As they return to their initial dispositions, fastener elements 14 gather and retain low-lying loops 32, in some cases maintaining a residual tension in the loops 32 due to the closing pincer motion.

During use, a separating load normal to the plane defined by base member 12 will tend to bend opposing cantilevered fastener elements 14 toward each other, further decreasing the separation distance between facing tips 34 and augmenting the engagement of the fastener elements 14 with the mating loops 32.

Figure 5:
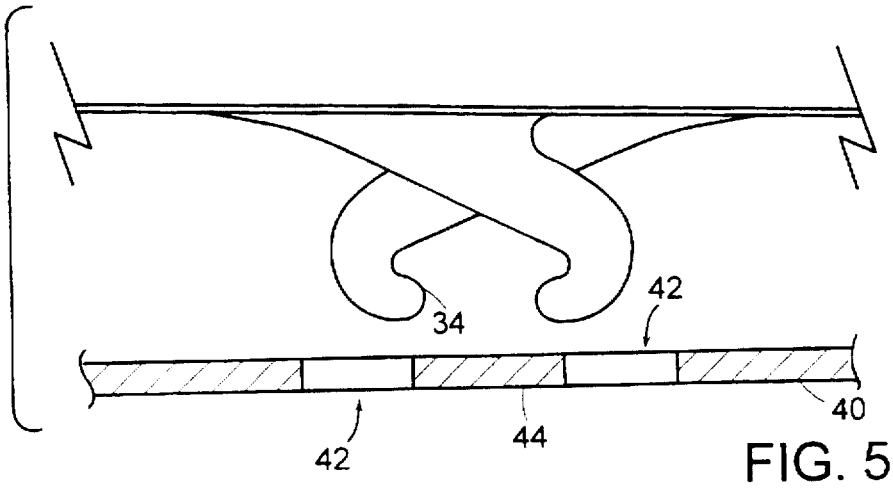
FIG. 5 illustrates a process and machine for making the hook fastener strip.
Figure 6:
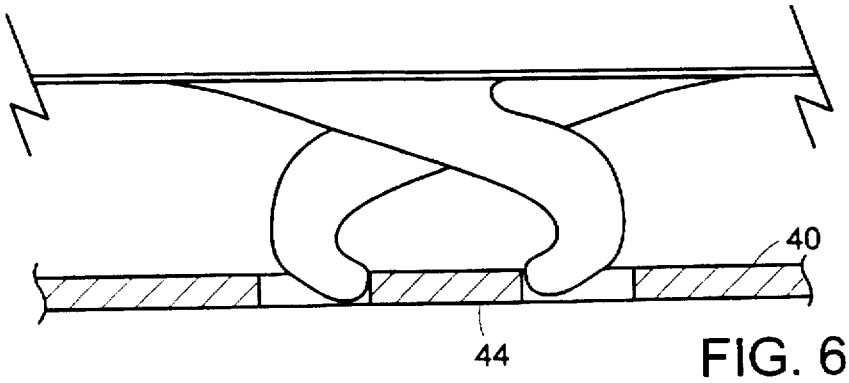
FIGS. 6 through 8 diagrammatically illustrate the engagement of the hook fastener elements with a mating member without loops.
Figure 7:
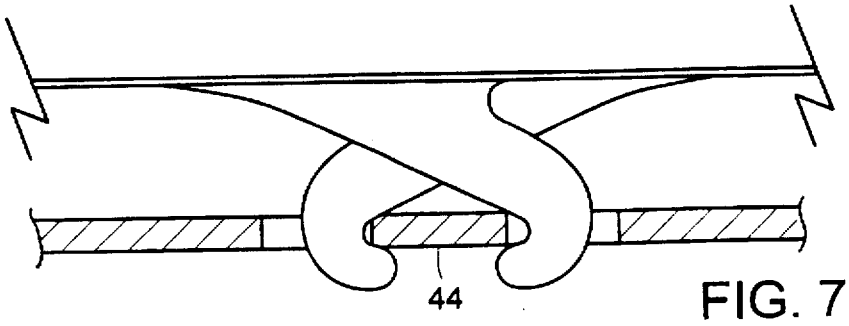

Although FIGS. 4A–4C show the fastener elements 14 engaging a fabric with loops 30, the inverted hook-shaped fastener element can be employed to engage the substance of any mating web 40 appropriately configured with penetrable area 42 having features fine enough to be grasped by the crooks 24 of the fastener elements 14. Such fasteners are illustrated diagrammatically as adjacent ledges 44 in FIGS. 5 through 7. In a similar pincer motion as described above, adjacent opposing fastener elements 14 bend away from each other under load to present the small distal tip 34 of the crook that penetrates the web 40 through the penetrable area 42, and grasps ledge 44 upon release.

Figure 8:
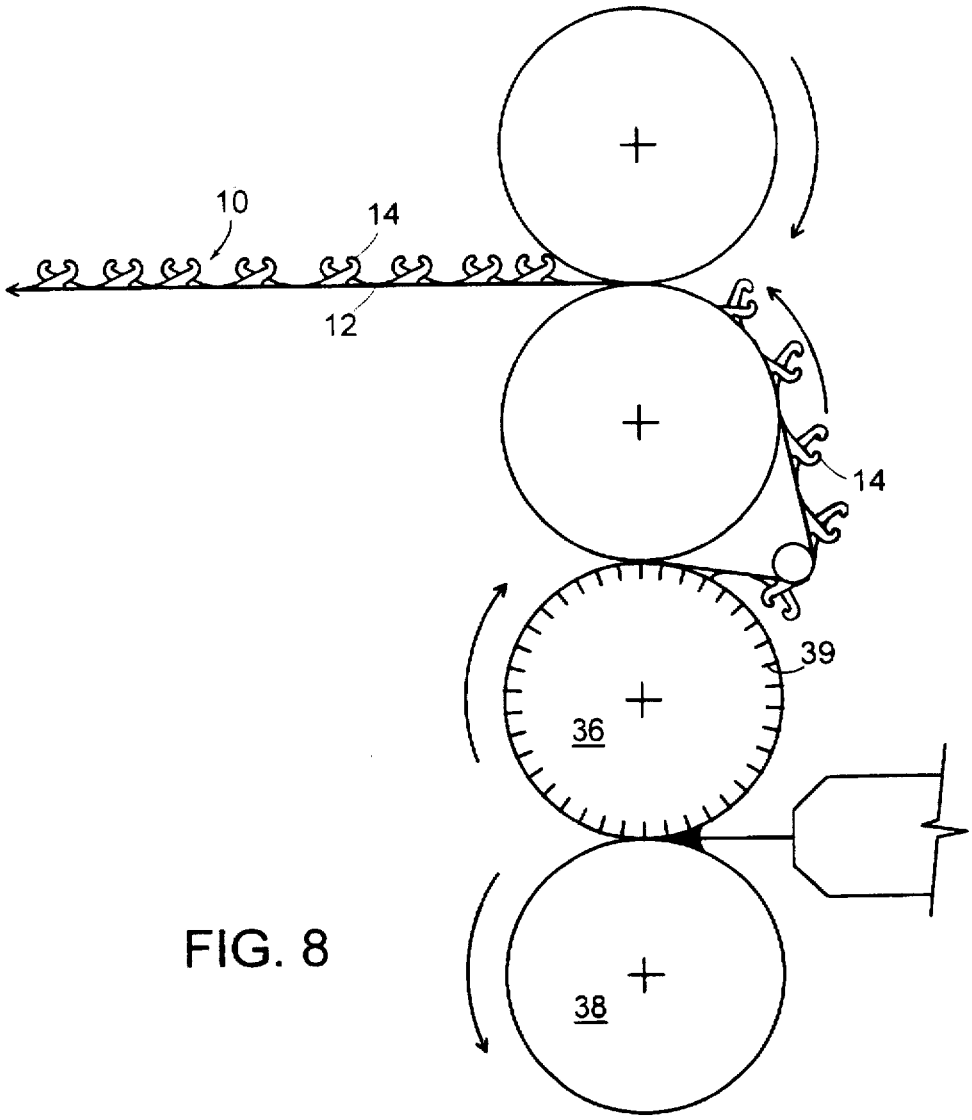

As shown in FIG. 8, a preferred method for making such a hook fastener strip entails extruding molten resin into the nip formed between a cooled mold roll 36 and a means for applying pressure. In the embodiment shown, roll 38 is employed to apply pressure as shown in Fischer, U.S. Pat. 4,794,028, fully incorporated herein by reference. The cooled mold roll has fixed mold cavities 39 about its periphery that are arranged to produce the molded fastener elements 14 integral with the base member 12. The formed fastener elements are stripped from the mold cavities without having to open the cavities, enabling the fastener strip to be produced in a continuous high speed molding process.

In some embodiments, the adjacent rows of fastener elements 14 do not face in opposite directions. The cantilevered fastener elements in this embodiment bend backward when pressed against a mating material, springing back when released to engage loops or other features, as described above, but without the complementary pincer motion developed by opposing elements. This configuration is useful, e.g. in applications where shear loads developed during use tend to be in a single direction that places the stems 22 of the fastener elements 14 in tension.

Figure 9:
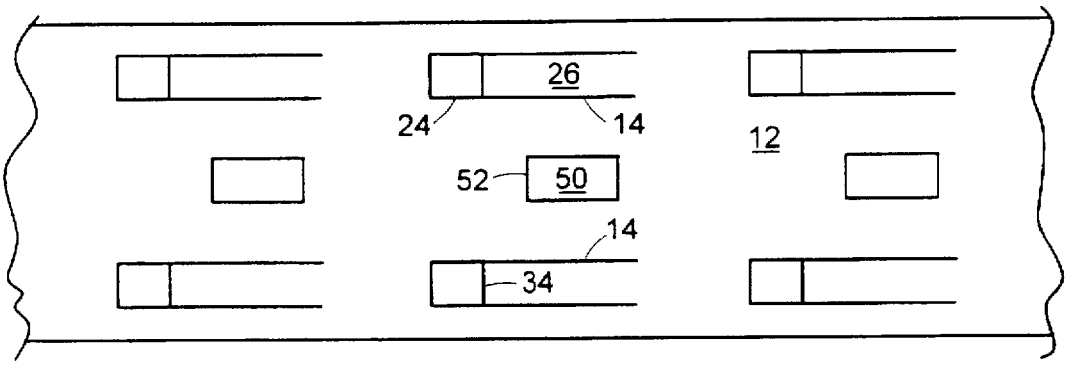
FIG. 9 is a diagrammatic plan view of a second embodiment of the hook fastener strip.
Figure 10:
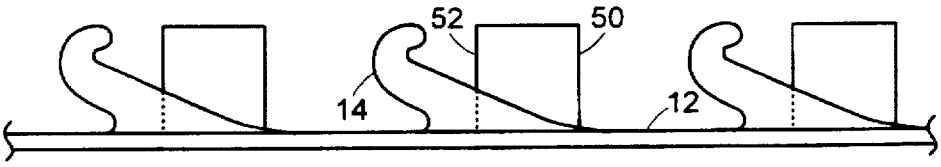
FIG. 10 is a side elevational view of the strip of FIG. 9.

In another embodiment, illustrated in FIGS. 9 and 10, the acute-angled fastener element 14 of FIG. 1 is arranged adjacent to an opposing structure 50, shown diagrammatically, which may be molded in the form of a post, conventional hook fastener element, or any other form that provides a cooperating opposed surface 52 that extends from base member 12. As suggested by the tapered form shown in FIGS. 9 and 10, opposing structure 50 is preferably constructed to deflect under a normal load to enable the loop material to deflect the cooperating acute-angled fastener element downward. Upon release of the normal load, opposing surface 52 helps to trap an engaged loop 32 within the crook 24 of the narrowly offset fastener element 14.

Figure 11:
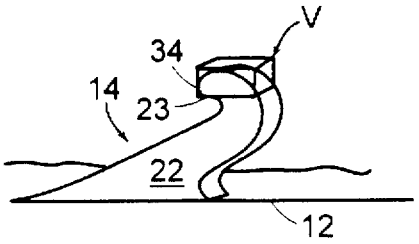
FIG. 11 is a perspective view of an inverted hook fastener element, illustrating displacement volume.

FIG. 11 illustrates displacement volume as it relates to the inverted hook fastener elements 14, as the volume of a rectangular parallelopiped V bounded by planes that include edges of the fastener element. The bottom plane is parallel to the base 12 and includes an interior ledge 23 of the crook. The top plane is parallel to the base and tangent to the top of the element at the point most distant from the base member. The side planes lie in planes projecting along the sides of the element. The first end plane is perpendicular to the bottom plane and includes the side of the intersection of the bottom plane and the stem 22 farthest from the tip 34, with the second end plane tangent to the portion of the tip 34 farthest from the first end plane. This volume is preferably below $0.20\times10^{-6}$ cubic inches to provide acceptable penetratability into non-wovens.

Figure 12:
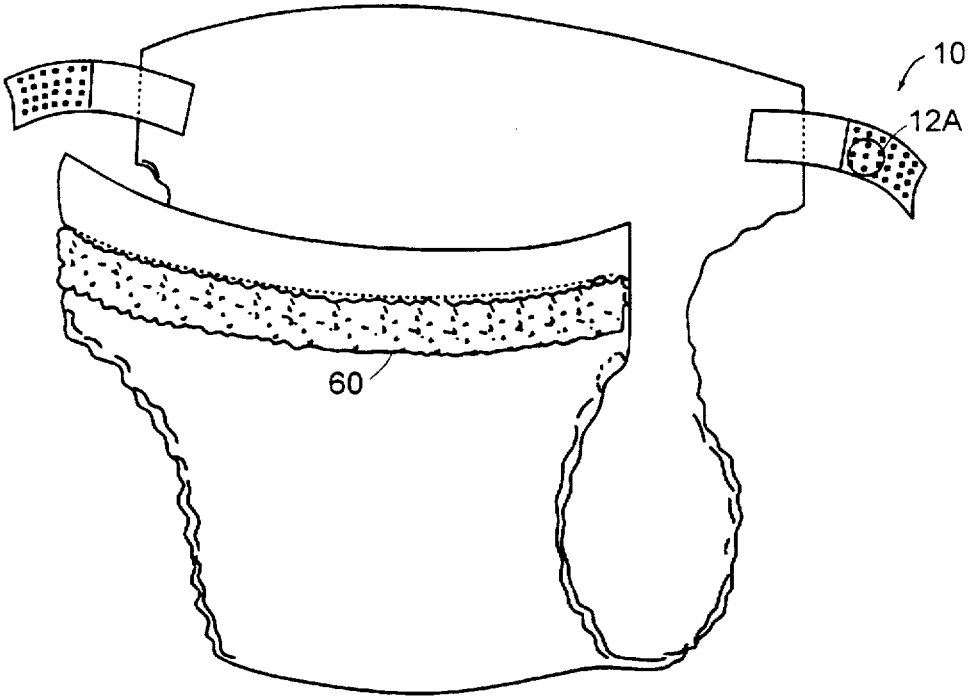
FIG. 12 is a view of a disposable diaper with fastener strips having inverted hook fastener elements.
Figure 12A:
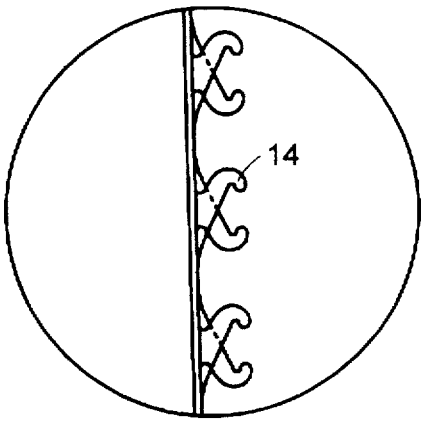

FIG. 12 is a view of a disposable diaper having attached fastener strips 10 with inverted hook fastener elements 14, arranged to engage an inexpensive non-woven material 60.

The fastener elements illustrated in the figures are adapted to be formed in fixed mold cavities fabricated by through-cutting of the profiles in a mold plate by EDM technology. Such mold plates are placed between flat or contoured spacer plates that close the sides of the mold cavities. Important aspects of the invention, however, have much wider applicability. Fixed mold cavities formed by photochemical milling techniques, such as disclosed in U.S. Ser. No. 08/659,368, the teachings of which are incorporated herein by reference, enable advantageous variations of the contours of the fastener elements. Instead of flat sides, rounded surfaces are readily formed that facilitate the interaction of the fastener elements with mating loops or other fastener features. Such contour control enables the adjustment of other parameters for the production of fastener elements that are specifically adapted to predetermined conditions of use.

In the case of continuous molding of the fastener elements using mold cavities formed by photo-chemical etching, the profiles of the elements can be arranged in rows in the machine direction, in the cross-machine direction, at angles thereto, or in other selected patterns. Likewise, using injection molding techniques, the orientation and arrangement of the fastener elements are advantageously varied according to specific requirements of the conditions of use.

In important instances, a molding apparatus having movable mold parts is alternatively employed that facilitates release of the fastener elements from their molds. For an example of a type of molding process that can be used for this purpose, see Menzin U.S. Pat. No. 3,762,000 which is hereby incorporated by reference. Parts of such molds can likewise be formed by the photochemical etching process.

It is also to be understood that simple fastener elements according to the invention, and pincer-like pairs of such fastener elements, can be advantageously combined with cooperating fastener features of other constructions to produce desired effects.

The fastener element constructions shown and described can be employed for fastenings having a very wide variety of attachment and release properties, to suit the particular application and the nature of the cooperating material with which the fastening elements interact. Besides fastening to non-woven materials, in certain embodiments the fastening elements are advantageously combined with other cooperating materials including woven, knit and foam materials to form releasable fasteners. In certain instances, fastener members employing features of the invention can be employed for permanently attaching materials and devices to receiving structures, the cantilever motion of the fastener elements facilitating entry into the surfaces of a preformed material such as a foam, but where desired, resisting subsequent removal. In still other instances, fastener elements according to the invention may be molded in place in foams or other structures to provide reinforcement and as a means to attach surface materials or objects to the molded structures.

These and other uses of the principles of the invention as described and claimed will be understood and are covered by the following claims.

What is claimed is:

1. A fastener member useful for separable engagement with surface fibers of a low-loft fabric, the fastener member comprising a base web; and a multitude of fastener elements formed with and extending from a base at the base web, at least some of the fastener elements having a profile that comprises:

an elongated stem adjacent the base web and inclined at an acute angle therewith; and a crook formed on the end of the stem distal to the base web, the crook directed oppositely to the direction of inclination of the stem and exposed for engaging cooperating fastening features.

2. The fastener member of claim 1 comprising a molded strip having at least one row of said fastener elements extending in the direction of extent of the strip, the profiles of said fastener elements of the row aligned with the row.

3. The fastener member of claim 1 wherein the fastener elements that have said profiles have a thickness of about 0.006 inch or less;

a height of about 0.015 inch or less from the base web; and a displacement volume defined as the volume of a rectangular parallelpiped having a bottom plane, first and second side planes, first and second end planes and a top plane; the bottom plane oriented parallel to the base and including an interior ledge of the crook, the top plane parallel to the base and tangent to the top of the element at the point most distant from the base, the side planes lying in planes projected along the sides of the element, the first end plane perpendicular to the bottom plane and including the side of the intersection of the bottom plane and said stem farthest from said tip, the second end plane tangent to the portion of said tip farthest from said first end plane;

wherein the displacement volume is less than about $0.20\times10^{-6}$ cubic inches.

4. The fastener member of claim 1 or 2 wherein said acute angle is between about 20 and 50 degrees, said stem being resiliently deflectable in motion toward said base web when said fastener member is engaged with face-to-face pressure against a mating member tending to open said crook outwardly and release of said pressure tending to close said crook in an engaging motion.

5. The fastener member of claim 4 wherein said acute angle is about 30 degrees.

6. The fastener member of claim 1 wherein the fastener elements having said profiles are arranged in offset pairs, which pairs comprise adjacent fastener elements that are opposed in pincer-like fashion such that the distal ends of the crooks in a pair are oriented to face generally toward each other, whereby force applied to said ends of said fastener elements toward said base web causes said fastener elements to move generally away from each other as the stems each flex relative to the base web, and the crooks move back toward each other upon removal of the force.

7. The fastener member of claim 6 wherein the fastener elements of a pair are disposed in adjacent parallel rows of fastener elements.

8. The fastener member of claim 6 wherein the fastener elements of an offset pair are separated by a distance of less than 0.008 inches.

9. The fastener member of claim 6 wherein said distal ends of the fastener elements of an offset pair, in an unstressed condition, are separated by a distance of about 0.010 inch or less in the direction of said rows.

10. The fastener member of claim 1 wherein at least some of said fastener elements having said profiles are each arranged in adjacent respective opposing structure that cooperates with the crook of said fastener element to engage said cooperating fastening features.

11. The fastener member of claim 10 wherein the opposing structures are post-shaped and have a height from said base approximating the height of said fastener elements.

12. A fastener member useful for separable engagement with surface fibers of a low-loft fabric, the fastener member comprising:

a base web; and a multitude of fastener elements formed with and extending about 0.015 inch or less from the base web, the thickness of the elements in the direction normal to their profile being about 0.006 inch or less, at least many of the fastener elements each having a profile that comprises:

an elongated stem adjacent the base web and inclined at an acute angle therewith; and a crook formed on the end of the stem distal to the base web, the crook directed oppositely to the direction of inclination of the stem and exposed for engaging a mating fastening feature; the fastener elements having said profile each having a displacement volume defined as the volume of a rectangular parallelepiped having a bottom plane, first and second side planes, first and second end planes and a top plane; the bottom plane oriented parallel to the base and including an interior ledge of the crook, the top plane parallel to the base and tangent to the top of the element at the point most distant from the base, the side planes lying in planes projected along the sides of the element, the first end plane perpendicular to the bottom plane and including the side of the intersection of the bottom plane and said stem farthest from said tip, the second end plane tangent to the portion of said tip farthest from said first end plane;

wherein the displacement volume is less than about $0.20\times10^{-6}$ cubic inches;

the fastener member comprising a strip having at least one row of fastener elements extending in the direction of extent of the strip, the profiles of said fastener elements aligned with the row.

13. A disposable garment having a non-woven fabric and the fastener member of claim 12 disposed to engage said non-woven fabric.

14. The disposable garment of claim 13 in which the garment is a diaper.

15. A fastener member having a multiplicity of fastener elements, at least many of which each comprises a stem extending as an angled cantilever arm in a first direction along a base web, and a hook carried on the free end of the cantilever arm and directed in a second direction, such that elastic deflection of the cantilever arm in movement toward the base web opens the hook, and elastic return motion of the cantilever arm to its undeflected position returns the hook to its initial disposition.

16. The fastener member of claim 15 having a set of two of said fastener elements, the fastener elements of the set directed generally toward each other such that said movements of their cantilever arms effectively, respectively, enlarges and reduces the distance between their hooks in a pincer-like motion.

17. The fastener member of claim 16 wherein said two fastener elements are offset from one another.

18. A fastening comprising a fastener member according to claim 15 and a mating non-woven fabric having surface fibers engageable by said hooks.

* * * * *